US005956872A

United States Patent [19]

Mavrianos

[11] Patent Number: 5,956,872

[45] Date of Patent: Sep. 28, 1999

[54] SELF CONTAINED SNOW REMOVAL APPARATUS

[76] Inventor: Kostas Mavrianos, 11901 Copper Mountain Cir., Eagle River, Ak. 99577

[21] Appl. No.: 08/927,910

[22] Filed: Sep. 11, 1997

[51] Int. Cl.[6] ..... E01H 5/10

[52] U.S. Cl. ..... 37/228; 126/343.5 R

[58] Field of Search ..... 37/227, 228, 226, 37/229, 230; 126/343.5 R, 343.5 A

[56] References Cited

U.S. PATENT DOCUMENTS

| | | | |
|---|---|---|---|
| 2,599,098 | 6/1952 | Flynn | 37/227 X |
| 2,602,443 | 7/1952 | Leary | 37/227 X |
| 2,605,760 | 8/1952 | Cayas | 37/228 X |
| 3,171,405 | 3/1965 | Miller | 37/227 X |
| 3,277,885 | 10/1966 | Gontcharuk | 37/227 X |
| 3,309,798 | 3/1967 | Devlin et al. | 37/228 |
| 3,484,961 | 12/1969 | Coslowsky | 37/227 |
| 3,619,918 | 11/1971 | Morin | 37/228 |
| 4,071,966 | 2/1978 | Cohen | 37/228 |
| 4,918,844 | 4/1990 | Marsh | 37/227 X |
| 5,588,231 | 12/1996 | Mavrianos | 37/227 |

*Primary Examiner*—Victor Batson
*Attorney, Agent, or Firm*—Michael J. Tavella

[57] ABSTRACT

A snow removal device that uses a truck frame to hold a snow collecting, melting and storage system. A duct carries snow from a snow blower, mounted on the truck, into a large hopper. The hopper is covered to prevent the snow from leaving the hopper. A number of pipes are nested in the hopper. Several torch blowers are connected to the pipes to directly fire into the pipes. Total usable heat generated exceeds 25 million BTUs. Melted snow is pumped from the hopper into separate holding tanks for disposal.

7 Claims, 4 Drawing Sheets

SELF CONTAINED SNOW REMOVAL APPARATUS

This invention relates to snow removal equipment and particularly to snow removal equipment that uses high BTU heat production for melting.

BACKGROUND OF THE INVENTION

In virtually all northern tier states and provinces snow removal is a major winter problem. In many areas, snow does not melt until spring. Removing snow from streets and roads takes an enormous amount of tax dollars. Equipment is used to plow the snow into ditches or uniform rows. Snow blowers and loaders are then used to move snow from the roads into off road ditches, lawns, or into dump trucks, for hauling the snow to large open snow dumps. In some locations these dump sites store piles of snow forty feet high or more. At these dumps, more equipment is needed to push the snow into piles and to keep the piles managed. Such activities cost communities dearly Even in rural areas, where snow removal is not as problematic, finding places to store snow can be difficult. Moreover, the cost of the equipment for rural snow removal and storage is also expensive.

My previous patent, U.S. Pat. No. 5,588,231 is a self-contained snow removal device. It uses a truck chassis or large tractor-trailer frame to hold a heavy duty snow blower, which is mounted on the front of the tractor. A duct carries the snow from the blower into a large hopper. A series of components is nested in the hopper as follows: A screen is placed near the top of the hopper to catch debris. Below the screen are two separate heater pipe systems that circulate hot water. Below the pipe systems is a series of pyramid heaters. Below the pyramid heaters is a catch basin to hold the melted snow (as water) at the bottom of the hopper. This water is then pumped into a tank, mounted on the back of the truck trailer. Hot water is provided by a pair of boilers also mounted on the trailer. Fuel for the boilers and the associated electrical equipment are also stored aboard the truck. The hopper is covered to prevent the snow from being blown out of the hopper, as well as keeping the heat within the hopper.

Although this design is compact, it melts snow too slowly for practical commercial operation. Thus, once the hopper is filled with snow, the truck must wait to melt the snow before it can continue. This increases the operating time per mile to an unacceptable level.

SUMMARY OF THE INVENTION

To solve the operating time problem, I have designed an improved snow melter that uses large quantities of heat to melt snow as quickly as possible. By using direct flame through pipes, more heat can be effectively transferred to the snow than by circulating water, which was used in my previous design.

My new design uses a truck mounted hopper that has 64 burners at 500,000 BTU per burner. These burners inject flame into 64 spaced apart pipes that are arranged in an overlapping pattern to increase thermal efficiency. Snow is introduced into the top of the burning chamber and allowed to fall onto the pipes, where it is melted. The melt water is removed into holding tanks for later dumping. In this way, a single truck can operate in an area to clear snow from roads in a cost effective manner compared to conventional road graders and truck hauling of snow.

It is an object of this invention to produce a self contained snow removal system.

It is another object of this invention to produce a snow removal system that collects, melts and stores snow and the water produced therefrom on one tractor trailer chassis.

It is yet a further object of this invention to produce a snow removal system that is capable of operating on rural or urban streets and roads.

DETAILED DESCRIPTION OF THE INVENTION

Figure 1:
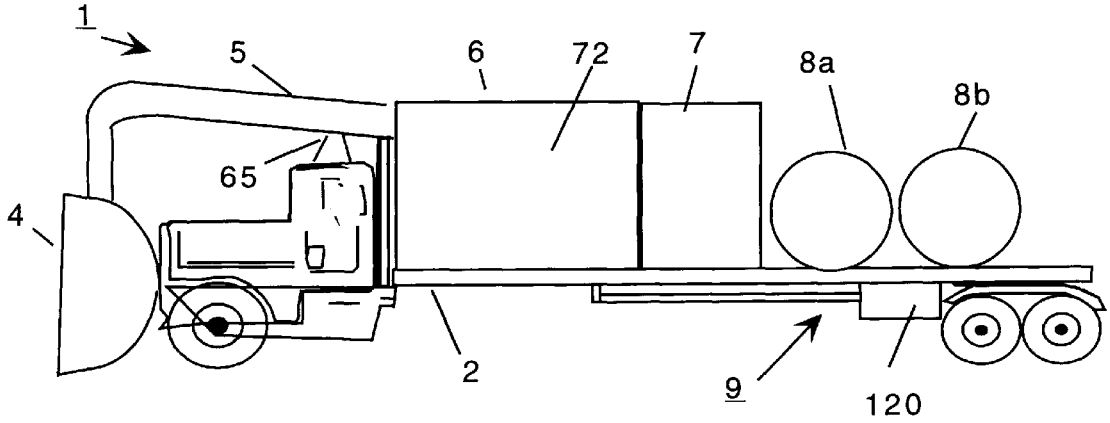
FIG. 1 is a left side view of the snow removal system mounted on a truck.

Referring now to FIG. 1, the snow removal system 1 is shown. The problem in melting snow is the amount of heat it takes to melt the snow. Under normal conditions it takes approximately 144 BTUs to melt one pound of snow. The problem is that when large quantities of snow are blown into a small (relatively) chamber, the amount of heat needed to melt the snow is significant. To melt 78 tons of snow per hour requires 32 million BTUs. As a result, packing a hopper full of snow results in the need for high heat production to melt the snow in a reasonable period of time. Otherwise, the truck unit must sit idly, melting snow that covered only a short distance on a road.

Figure 2:
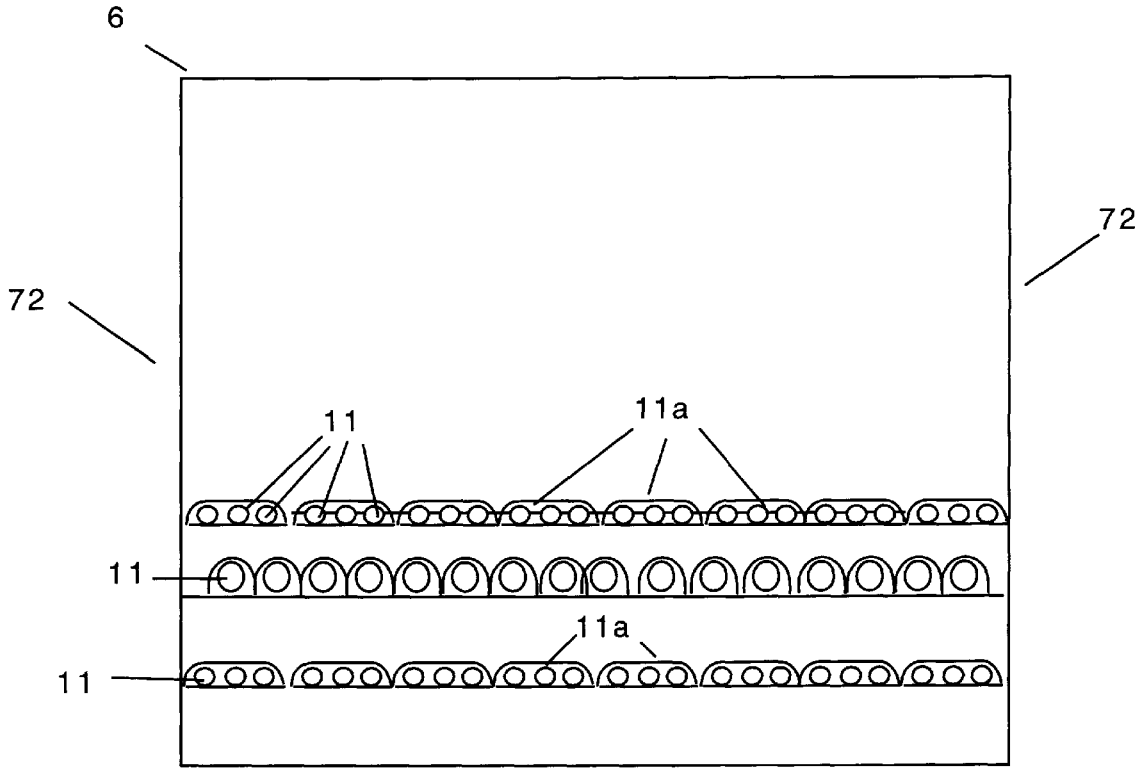
FIG. 2 is a rear detail view of the melting hopper showing the arrangement of melting pipes.
Figure 3:
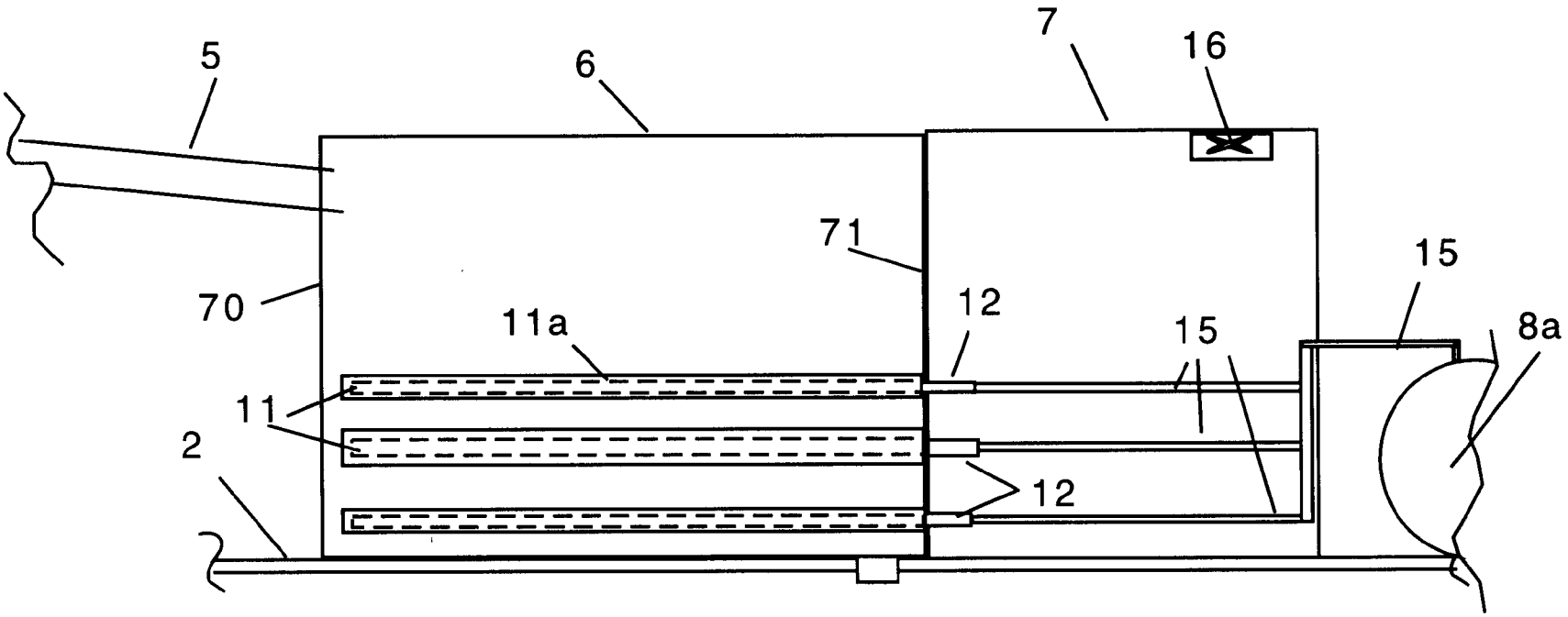
FIG. 3 is a side detail view of the melting hopper and the furnace room showing the arrangement of the melting pipes.

To reduce this waiting time to as short as possible, the hopper is designed to be more compact and longer than my original design. To heat the snow, 64 torch blowers, rated at 500,000 BTU each, are installed in a separate compartment behind the hopper. The torch blowers feed into a number of hollow pipes that are used for heat transfer. The pipes are spaced in a pattern as shown in FIGS. 2 and 3. Covers are provided over the pipes as shown to help disperse the snow and the melting water efficiently over the pipes. In this way, heat transfer is maximized.

The amount of available heat can be increased by extracting the waste heat from the truck and generator exhausts. This waste heat can be captured and funneled back into the heating system to help reduce fuel consumption. In the preferred embodiment, the burners are fueled by propane or compressed natural gas. Fuel oil may be used as well, but is not preferred.

Melt water is separated from debris at the bottom of the hopper. The melt water is then moved to a holding tank for storage and eventual disposal. In the preferred embodiment, the holding tank holds about 7,000 gallons of water.

Figure 5:
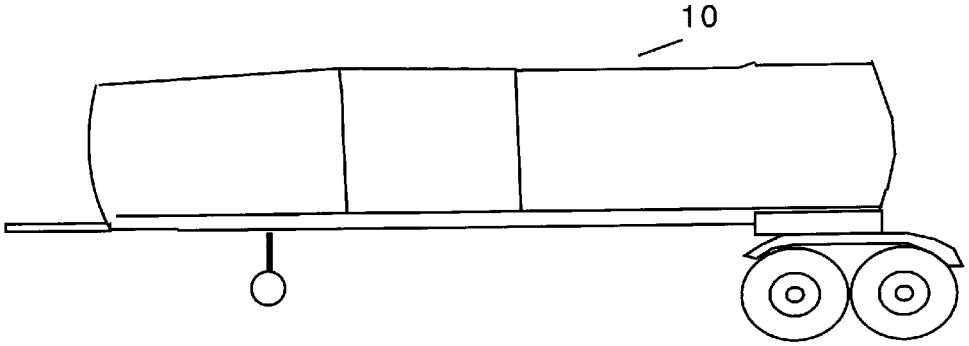
FIG. 5 is a side view of the water tank trailer.

The device as shown on the drawings is designed to be mounted on a standard truck having a cab and a rear platform. The main components of the system are: a standard road type snow blower 4, a feeder chute 5, a melting hopper 6, a furnace room 7, a propane storage tank 8*a,* and an oil storage tank 8*b.* Other major components include a water pumping system 9 and a water storage tank 10. FIG. 5 shows the water tank 10. These components are discussed in detail below.

The key element of this system is the melting hopper 6. Details of the melting hopper 6 are shown in FIGS. 2 and 3.

Figure 4:
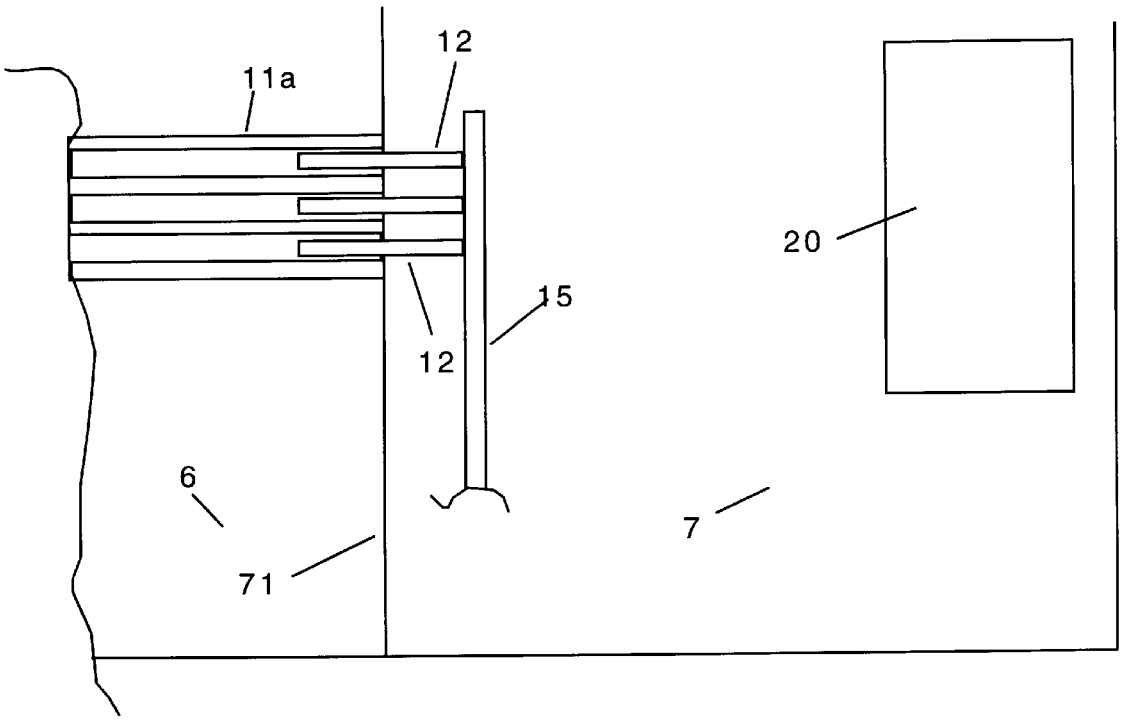
FIG. 4 is a top view of the furnace room.

The hopper has a front wall 70, a rear wall 71, and two side walls 72. FIG. 3 is a side view of the melting hopper 6 with the side wall 72 removed. At the bottom of the melting hopper 6 are 64 pipes 11. See also FIG. 2, which shows the end view of the pipes 11. Note that as shown in FIG. 3, the pipes 11 do not run the entire length of the hopper 6. In the preferred embodiment, the pipes 11 end 4 inches short of the front wall 70. This ensures that the front wall 70 is protected from excessive heat. The pipes 11 are fitted to 64 torch blowers 12, each torch blower 12 having a capacity of 500,000 BTU. (See FIG. 4) The sixty-four torch blowers 12 are used to generate 32 million total BTUs, At 80 percent heat transfer efficiency, these torch blowers produce 25.6 million BTUs. The torch blowers 12 are shown in FIG. 4, as discussed below. Thirty-two million BTUs are needed for optimum operation. A lesser amount of heat cannot melt snow quickly enough for economic operation. While any amount of heat can melt snow given enough time, such melting is not cost effective.

Figure 6:
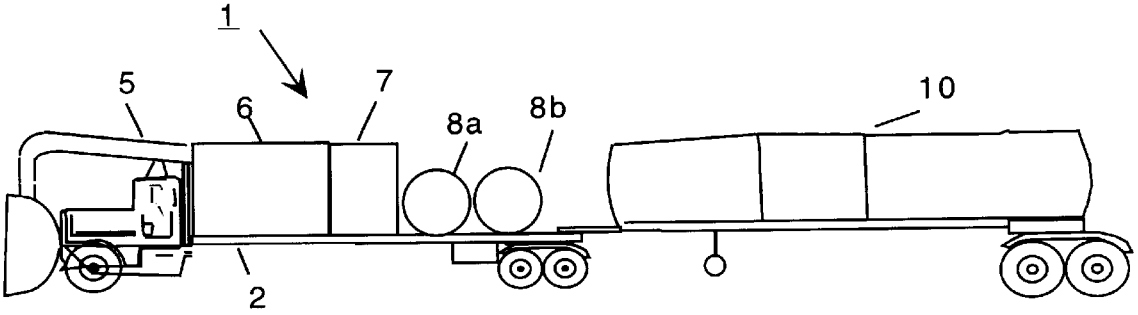
FIG. 6 is a side view of the snow removal system truck towing the water trailer.

FIGS. 1, and 6 show details of the snow delivery system 1. A standard road type rotary snow blower 4 is mounted on the front of the tractor 2 as shown. Unlike ordinary snow blowers, which discharge snow from the blower into a chute where it is directed away from the truck 2 and merely blown into the air, this snow blower 4 has a duct (feeder chute) 5 attached to the output chute. This duct feeds into the hopper 6 as shown. The duct 5 is supported with legs 65 that extend above the cab as shown. As snow is blown into the melting hopper 6, it strikes the pipes 11 where rising heat causes the snow to melt. The melting snow passes through the pipes 11 ensuring thorough melting. The pipes 11 are covered with metal covers 11*a* as shown. These covers help to disburse the heat evenly through the lower portion of the hopper and serve to prevent debris from touching the pipes 11. Moreover, the pipes 11 are arranged in a pattern as shown in the drawings. There are three layers of pipes. In the first layer, twenty-four pipes are arranged in eight groups of three. Each group of three pipes has a separate cover 11*a* as shown. The second layer has sixteen single pipes 11, each with a separate cover 11*b* as shown. Finally, the third, or bottom, layer repeats the pattern of the first layer in that twenty-four pipes are arranged in groups of three, with each group of three having a separate cover 11*a* as shown.

Water collected at the bottom of the hopper 6 passes through to the bottom of the hopper 6, where it is collected and pumped through the pump system 9, using a pump 120, into the holding tank 10. The holding tank 10 is towed behind the truck, as shown in FIG. 6. In this way, a full tank can be dumped into a street drain, or can be disconnected from the melting truck for disposal by another vehicle, while another empty tank trailer is attached to the melting truck.

Referring now to FIG. 4, in the preferred embodiment, the torch blowers 12 are propane fired and are arranged in a furnace room 7 located behind the hopper 6. The torch blowers are fed liquid propane through a manifold system 15 as shown. Liquid propane is preferred because in the winter, the temperatures may be too low to provide adequate pressures to maintain full heat output. Note that the manifold system 15 is kept at a distance from the torch blowers 12 to maintain a thermal space between the manifold system 15 and the torch blowers 12. An exhaust fan 16 is also provided to exhaust any potentially hazardous fumes from building up in the furnace room. The manifold system is connected to the propane tank 8*a* using ordinary techniques know in the art.

A generator 20 is provided to provide ignition power for the torch blowers 12, the fan 16 and other equipment and to provide lighting as needed. The generator 20 is installed using standard techniques. A separate fuel oil tank 8*b* is used to fuel the generator.

To use the system snow is blown from the road surface into the melting hopper 6, where heat causes the snow to melt. Melt water is collected in the bottom of the hopper 6 where it is pumped, using a pump 120, into the water tank 10 for storage and ultimate disposal. Although a water tank 10 is the preferred storage device, any suitable container may be used.

The system can be operated by a one or two person crew and no additional support people or equipment are needed.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A snow removal system comprising:

a) a means for collecting snow from a ground surface;

b) a hopper, having a front wall, a rear wall, two disposed sides and a floor;

c) a means for transferring the snow from the means for collecting snow, to said hopper;

d) a plurality of heating pipes, placed within said hopper, wherein the number of heating pipes equals 64 pipes;

e) a plurality of torch blowers, removably attached to said plurality of pipes, such that for each pipe, there is a corresponding torch blower;

f) a means for providing fuel to said plurality of torch blowers g) wherein the plurality of heating pipes are arranged in a pattern of twenty-four pipes in a first layer, sixteen pipes in a second layer, placed below said first layer, and twenty-four pipes in a third layer, placed below said second layer;

h) wherein the plurality of pipes have a plurality of covers fixedly placed above said plurality of pipes, wherein the plurality of covers are placed above said plurality of pipes in a pattern wherein the first layer of pipes is formed into eight groups of three pipes each and wherein each first layer group of three pipes has one of said plurality of covers; wherein the second layer of pipes is formed into sixteen individual pipes, each individual pipe having one of said plurality of covers; and wherein the third layer of pipes is formed into eight groups of three pipes each and wherein each third layer group of three pipes has one of said plurality of covers.

2. The snow removal system of claim 1 further comprising a water storage tank; and a means for filling said water storage tank from said hopper.

3. The snow removal system of claim 1 wherein a combined thermal output of the plurality of torch blowers is at least 25 million BTUs.

4. The snow removal system of claim 2 wherein the snow removal system is mounted on a truck chassis.

5. The snow removal system of claim 4 wherein the water tank is removably hitched to the truck chassis.

6. The snow removal system of claim 1 wherein the means for providing fuel to said plurality of torch blowers includes a manifold piping system.

7. The snow removal system of claim 1 wherein the plurality of torch burners are fueled with liquid propane.

* * * * *